US005511328A

United States Patent [19]

Fingerer et al.

[11] Patent Number: 5,511,328

[45] Date of Patent: Apr. 30, 1996

[54] HAND-OPERATED SNOW PLOW WITH ADJUSTABLE BLADES

[76] Inventors: Joseph C. Fingerer, 27 Ledbury St., North York, Ontario, Canada, M5N 248; Ephraim I. Alon, 55 Shelborne Avenue, Toronto, Ontario, Canada, M5N-1Y9

[21] Appl. No.: 323,765

[22] Filed: Oct. 17, 1994

[51] Int. Cl.[6] ..... E01H 5/02

[52] U.S. Cl. ..... 37/285; 37/281; 37/265; 37/283; 37/278; 294/54.5

[58] Field of Search ..... 37/285, 284, 283, 37/278, 265, 266, 434; 294/54.5; 403/93, 92, 98, 97

[56] References Cited

U.S. PATENT DOCUMENTS

| | | | |
|---|---|---|---|
| 453,776 | 6/1891 | McCory | 403/93 X |
| 731,419 | 6/1903 | Wykoff | 37/278 X |
| 987,918 | 3/1911 | Schmid et al. | 403/93 X |
| 1,075,154 | 10/1913 | Mansfield | 37/278 |
| 1,847,133 | 3/1932 | Nieman | 37/283 |
| 2,432,780 | 12/1947 | Mader | 37/278 X |
| 2,530,856 | 11/1950 | Callahan | 37/283 |
| 2,629,946 | 3/1953 | Ewers et al. | 37/283 X |
| 2,658,804 | 11/1953 | Andrews | 403/93 |
| 2,715,786 | 8/1955 | Dorko | 37/284 X |
| 2,967,363 | 1/1961 | Meier | 37/283 |
| 3,126,969 | 3/1964 | Sewell | 37/266 X |
| 3,248,811 | 5/1966 | Pravednekow | 37/265 |
| 3,526,979 | 9/1970 | Ladewski | 37/278 X |
| 4,910,893 | 3/1990 | Asay | 37/285 X |
| 5,159,769 | 11/1992 | Odorisio | 37/284 X |
| 5,309,654 | 5/1994 | Mathis | 37/285 X |

*Primary Examiner*—Terry Lee Melius
*Assistant Examiner*—Victor Batson

[57] ABSTRACT

A hand-operated snow plow with adjustable blades for plowing snow comprising an elongated housing with a front end and a rear end; a pair of elongated and generally opposed blades each having an end pivotally coupled to the front end of the housing; a blade adjustment mechanism for allowing independent angular positioning and securement of each of the blades with respect to the front end of the housing for thereby enabling the blades to be placed in a plurality of plowing positions; and a rigid handle extended upwards from the housing for allowing a user a firm hold for plowing.

2 Claims, 3 Drawing Sheets

HAND-OPERATED SNOW PLOW WITH ADJUSTABLE BLADES

BACKGROUND OF THE INVENTION

1. Field of the Invention

The present invention relates to a hand-operated snow plow with adjustable blades and more particularly pertains to plowing snow from an area with a hand-operated snow plow with adjustable blades.

2. Description of the Prior Art

The use of snow plow mechanisms is known in the prior art. More specifically, snow plow mechanisms heretofore devised and utilized for the purpose of plowing and removing snow are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,248,811 to Pravednekow discloses a combination snow plow and scoop. U.S. Pat. No. 3,431,661 to Carlson discloses a snow plow with laterally expansible fixed angle plow portions. U.S. Pat. No. 3,664,042 to Duran discloses a hand operated wheeled V-blade snowplow. U.S. Patent No. 4,512,091 to Leininger et al. discloses a snow plow scoop. U.S. Pat. No. 4,796,367 to Kulat discloses an adjustable manual snow plow. U.S. Pat. No. 5,159,769 to Odorisio discloses a materials handling device.

While these devices fulfill their respective, particular objective and requirements, the aforementioned patents do not describe a hand-operated snow plow with adjustable blades that has blades that can be radially positioned in a variety of angular configurations for allowing a user to push snow or debris forwards, to the left, or to the right when plowing.

In this respect, the hand-operated snow plow with adjustable blades according to the present invention substantially departs from the conventional concepts and designs of the prior art, and in doing so provides an apparatus primarily developed for the purpose of plowing snow from an area.

Therefore, it can be appreciated that there exists a continuing need for new and improved hand-operated snow plow with adjustable blades which can be used for plowing snow from an area. In this regard, the present invention substantially fulfills this need.

SUMMARY OF THE INVENTION

In the view of the foregoing disadvantages inherent in the known types of snow plow mechanisms now present in the prior art, the present invention provides an improved hand-operated snow plow with adjustable blades. As such, the general purpose of the present invention, which will be described subsequently in greater detail, is to provide a new and improved hand-operated snow plow with adjustable blades and method which has all the advantages of the prior art and none of the disadvantages.

To attain this, the present invention essentially comprises, in combination, a rigid housing having a V-shaped front wall, a top wall and a bottom wall coupled to the front wall, and a pair of opposed side walls interconnecting the front wall, top wall, and bottom wall to define a hollow interior and a rear opening for allowing access to the interior, and a central axis defined therethrough from the midpoint of the apex of the front wall to the centroid of the rear opening. A pair of rigid rectangular blades are included with each having a front surface coated with a layer of a non-stick material for preventing snow from adhering thereto, a rear surface, and periphery interconnecting the front surface with the rear surface and with the periphery further having a pair of opposed vertical short edges and a pair of opposed horizontal long edges and with a short edge of each blade pivotally coupled to the apex of the front wall. A pair of elongated adjusting plates are included with each having a planar and generally circularly-shaped interior portion and an elongated tapered exterior portion extended outwards from the interior portion with each interior portion pivotally coupled to the apex of the front wall and further including a first, a second, and a third slot peripherally formed thereon and with each exterior portion coupled to a separate blade against the rear surface thereof. A spring-loaded locking lever is included and coupled to the top wall at a location securable within the slots of the adjusting plates for allowing fixed and independent angular positioning of the blades for thereby enabling them to be placed in a plurality of plowing positions. The locking lever is positionable within the first slot of one of the adjusting plates for placing the associated blade in a position such that an acute angle is formed between it and the central axis of the housing. The locking lever is further positionable within the second slot of one of the adjusting plates for placing the associated blade in a position such that a perpendicular angle is formed between it and the central axis of the housing. The locking lever is further positionable within a third slot of one of the adjusting plates for placing the associated blade in a position such that an obtuse angle is formed between it and the central axis of the housing. Lastly, a rigid handle is included and has a horizontal short leg coupled to the top wall of the housing near the rear opening thereof and a long leg extended upwards therefrom and away from the housing and terminated at a handgrip for allowing a user a firm hold for plowing.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hand-operated snow plow with adjustable blades which has all the advantages of the prior art snow plow mechanisms and none of the disadvantages.

It is another object of the present invention to provide a new and improved hand-operated snow plow with adjustable blades which may be easily and efficiently manufactured and marketed.

It is a further object of the present invention to provide a new and improved hand-operated snow plow with adjustable blades which is of durable and reliable construction.

An even further object of the present invention is to provide a new and improved hand-operated snow plow with adjustable blades which is capable of being manufactured at a low cost with regard to both materials and labor, and which accordingly is then susceptible of low prices of sale to the consuming public, thereby making such a hand-operated snow plow with adjustable blades economically available to the buying public.

Still yet another object of the present invention is to provide a new and improved hand-operated snow plow with adjustable blades which provides in the apparatuses and methods of the prior art some of the advantages thereof, while simultaneously overcoming some of the disadvantages normally associated therewith.

Even still another object of the present invention is to provide a new and improved hand-operated snow plow with adjustable blades for plowing snow from an area.

Lastly, it is an object of the present invention to provide a new and improved hand-operated snow plow with adjustable blades comprising an elongated housing with a front end and a rear end; a pair of elongated and generally opposed blades each having an end pivotally coupled to the front end of the housing; blade adjustment means for allowing independent angular positioning and securement of each of the blades with respect to the front end of the housing for thereby enabling the blades to be placed in a plurality of plowing positions; and a rigid handle extended upwards from the housing for allowing a user a firm hold for plowing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
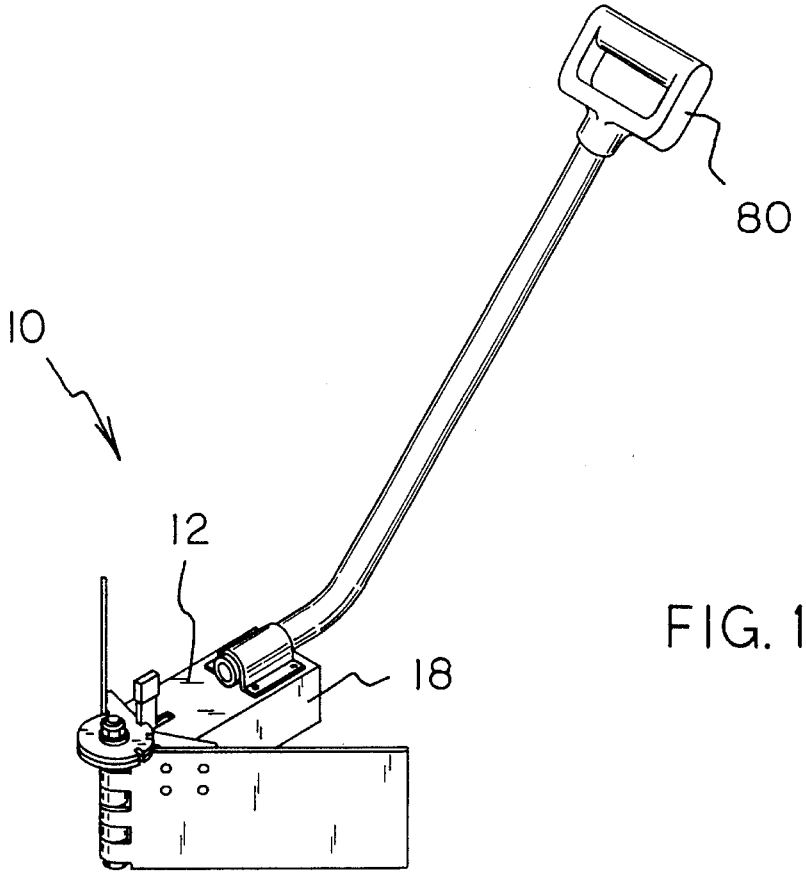
FIG. 1 is a perspective view of the preferred embodiment of the hand-operated snow plow with adjustable blades constructed in accordance with the principles of the present invention.
Figure 2:
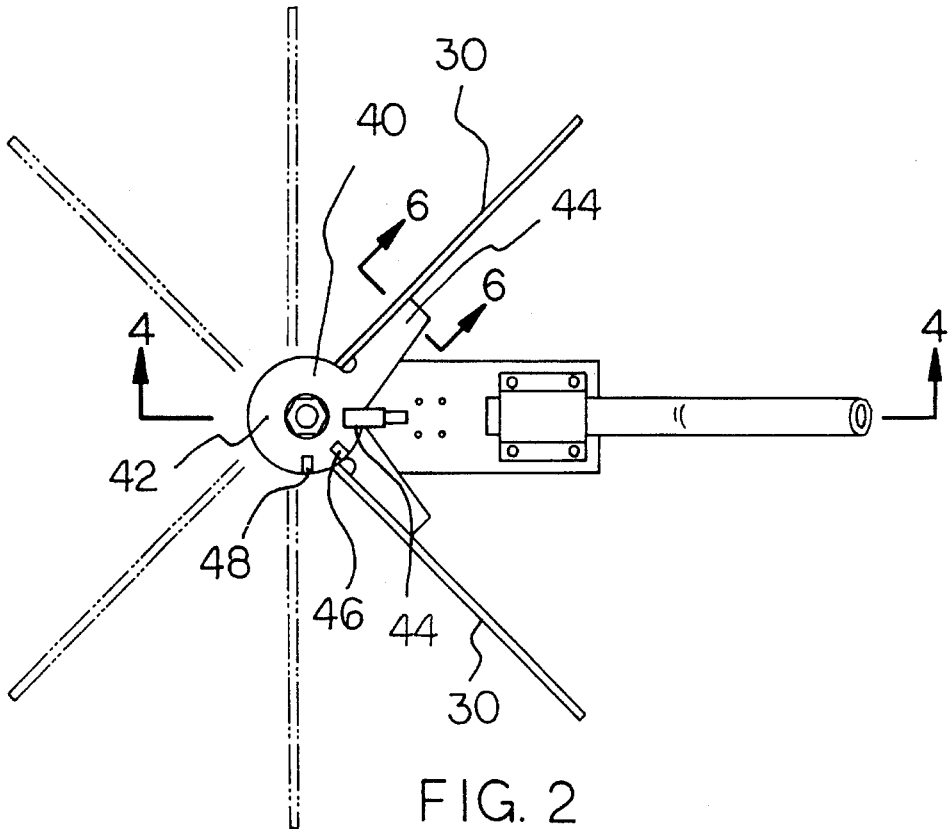
FIG. 2 is a plan view of the present invention depicting the blades in one of its three setable positions for plowing and removing snow.
Figure 3:
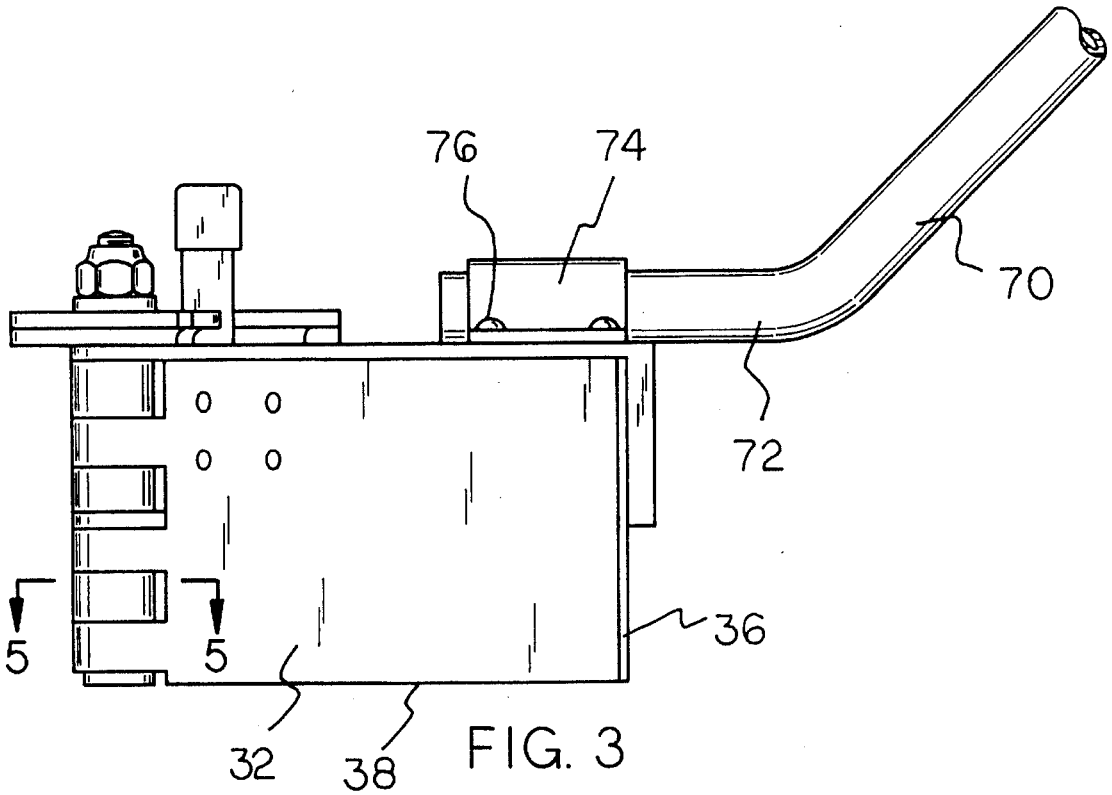
FIG. 3 is a side-elevational view of the present invention.
Figure 4:
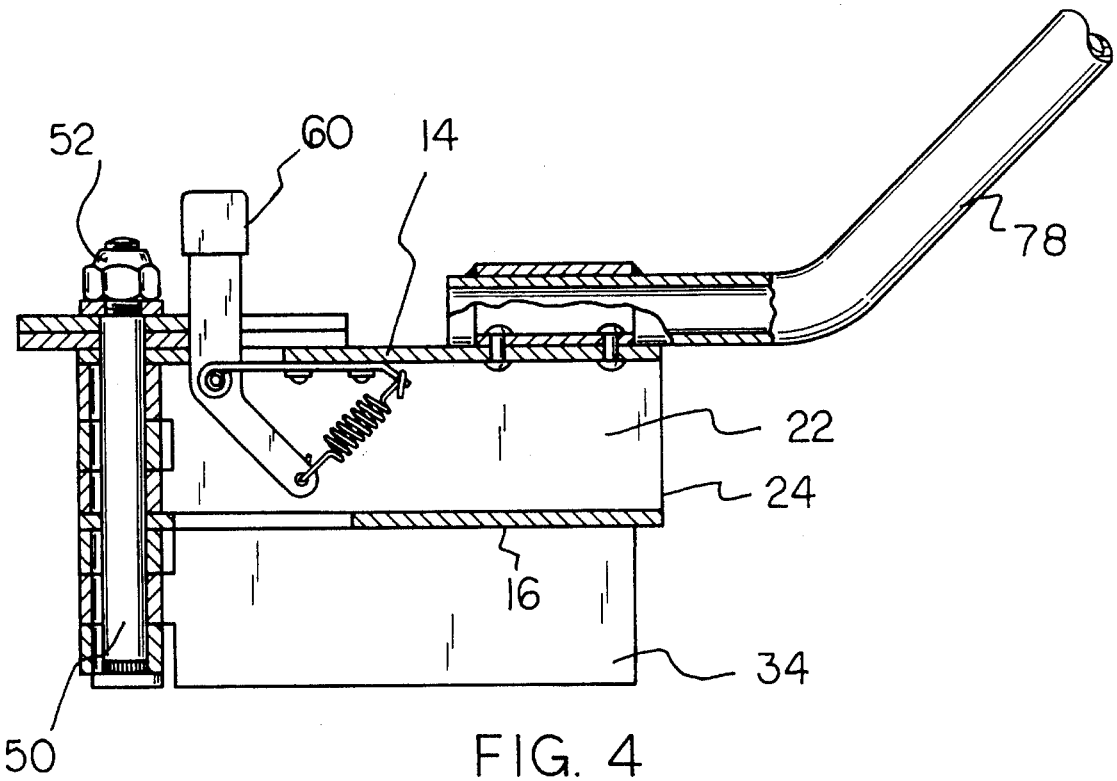
FIG. 4 is a cross-sectional view of the present invention taken along the line 4—4 of FIG. 2.
Figure 5:
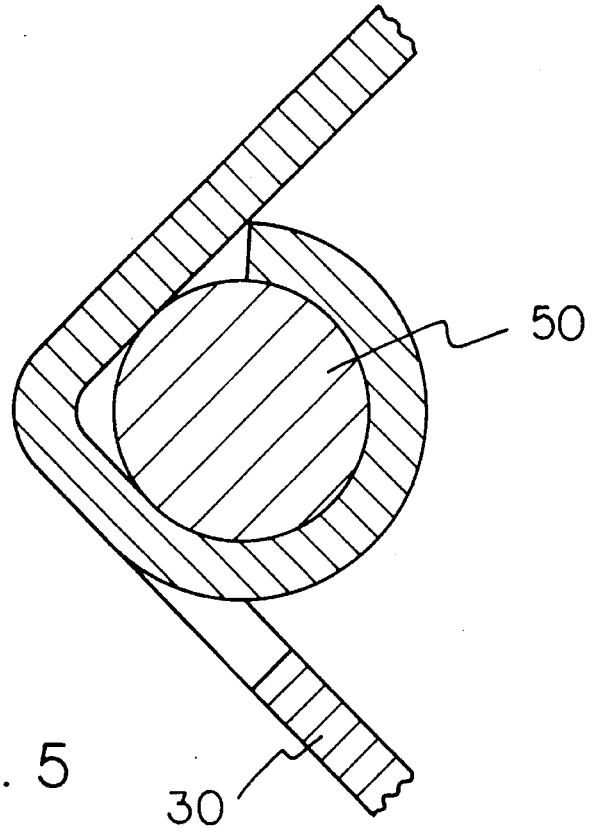
FIG. 5 is a cross-sectional view of the present invention taken along the line 5—5 of FIG. 3.
Figure 6:
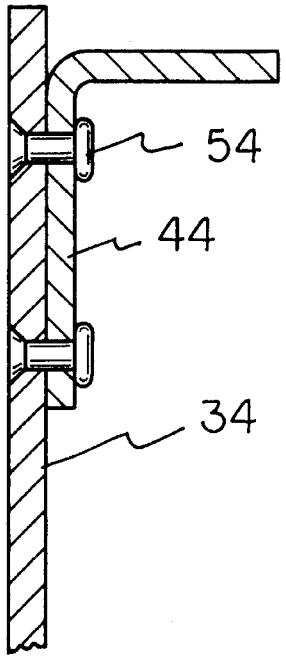
FIG. 6 is a cross-sectional view of the present invention taken along the line 6—6 of FIG. 2.

With reference now to the drawings, and in particular, to FIG. 1 thereof, the preferred embodiment of the new and improved hand-operated snow plow with adjustable blades embodying the principles and concepts of the present invention and generally designated by the reference number 10 will be described.

Specifically, the present invention essentially includes five major components. The major components are the housing, blades, adjusting plates, locking lever, and handle. The major components are interrelated to provide the intended function of plowing snow from an area.

More specifically, it will be noted in the various Figures that the first major component is the housing 12. The housing is rigid in structure. It has a V-shaped front wall, a top wall 14, and a bottom wall 16 coupled to the top wall. The housing also includes a pair of opposed side walls 18 interconnecting the front wall, top wall, and bottom wall to thereby define a hollow interior 22 and a rear opening 24 for allowing access to the interior. The housing also includes a central axis defined therethrough from the midpoint of the apex of the front wall to the centroid of the rear opening.

The second major component is the blades 30. The present invention includes a pair of blades. The blades are rigid in structure. Each blade has a front surface 32 and a rear surface 34. The front surface is coated with a layer of non-stick material such as Teflon for preventing snow from adhering thereto when plowing. The blades each have a periphery interconnecting the front surface with the rear surface. The periphery includes a pair of opposed vertical short edges 36 and a pair of opposed horizontal long edges 38. A short edge of each blade is pivotally coupled to the apex of the front wall. The short edges of the blades that are coupled to the apex of the front wall are formed in the shape of a hinge.

The third major component is the adjusting plates 40. The present invention includes a pair of adjusting plates. The adjusting plates are elongated and rigid in structure. Each adjusting plate has a planar and generally circularly-shaped interior portion 42 and an elongated tapered exterior portion 44 extended outwards from the interior portion. Each interior portion is pivotally coupled to the apex of the front wall. Each interior portion further includes a first slot 44, a second slot 46 and a third slot 48 peripherally formed thereon in a radial configuration. Each exterior portion is coupled to a separate blade against the rear surface thereof with rivets 54. The pivotal coupling of the adjustment plates and the blades to the apex of the housing is performed with a shoulder bolt 50 secured with a complimentary self-locking nut 52.

The fourth major component is the locking lever 60. The locking lever is rigid ion structure and is spring-loaded. The locking lever is coupled to the top wall at a location such that it may be urged into the slots of the adjusting plates 40 for allowing fixed and radial independent positioning of the blades. By allowing fixed and radial independent positioning of the blades, nine plowing positions may be realized. The plowing positions may be formed such that snow may be plowed in a forward direction, or plowed to either side of the blades. The locking lever is positionable within the first slot of one of the adjusting plates for placing the associated blade in a position such that an acute angle is formed between it and the central axis of the housing with the blade abutted against the front wall of the housing. Designating the apex of the front wall of the housing as the north position, the position associated with the acute angle is defined as the southwest position with respect to one blade and the southeast position with respect to the other blade. The locking lever is further positionable within the second slot of one of the adjusting plates for placing the associated blade in a position such that a perpendicular angle is formed between it and the central axis of the housing. The position associated with the perpendicular angle is defined as either the west position with respect to one blade or the east position with respect to the other blade. The locking lever is further positionable within a third slot of one of the adjusting plates for placing the associated blade in a position such that an obtuse angle is formed between it and the central axis of the housing. The position associated with the obtuse angle is defined as either the northwest position with respect to one blade or the northeast position with respect to the other blade.

The fifth major component is the handle 70. The handle is rigid in structure. It has a horizontal short leg 72 coupled to the top wall with a clamp 74 and rivets 76. This coupling is performed on the housing near the rear opening. The handle also includes a long leg 78 extended upwards from the short leg and away from the housing. The long leg is terminated at a hand grip 80 for allowing a user a firm hold for plowing.

The present invention is a unique type of snow plow or remover for directing snow to either the left, right or both sides of a path to be plowed, the shovel works by manual manipulation of the shovel blades to varying degrees thereby causing variable directing of snow placement. The blades of the present invention are coated with a non-stick material such as "TEFLON".

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A hand-operated snow plow with adjustable blades for plowing from an area comprising, in combination:

a rigid housing having a V-shaped front wall, a top wall and a bottom wall coupled to the front wall, and a pair of opposed side walls interconnecting the front wall, top wall, and bottom wall to define a hollow interior and a rear opening for allowing access to the interior, and a central axis defined therethrough from the midpoint of the apex of the front wall to the center of the rear opening;

a pair of rigid rectangular blades each having a front surface coated with a layer of a non-stick material for preventing snow from adhering thereto, a rear surface, and periphery interconnecting the front surface with the rear surface with the periphery further having a pair of opposed vertical short edges and a pair of opposed horizontal long edges and with a short edge of each blade pivotally coupled to the apex of the front wall;

a pair of elongated adjusting plates each having a planar and generally circularly-shaped interior portion and an elongated tapered exterior portion extended outwards from the interior portion with each interior portion pivotally coupled to the apex of the front wall and further including a first, a second, and a third slot peripherally formed thereon and with each exterior portion coupled to a separate blade against the rear surface thereof;

a spring-loaded locking lever coupled to the top wall at a location securable within the slots of the adjusting plates for allowing fixed and independent angular positioning of the blades for thereby enabling them to be placed in a plurality of plowing positions, the locking lever positionable within the first slot of one of the adjusting plates for placing the associated blade in a position such that an acute angle is formed between the blade and the central axis of the housing, the locking lever further positionable within the second slot of one of the adjusting plates for placing the associated blade in a position such that a perpendicular angle is formed between the blade and the central axis of the housing, the locking lever further positionable within a third slot of one of the adjusting plates for placing the associated blade in a position such that an obtuse angle is formed between the blade and the central axis of the housing; and a rigid handle having a horizontal short leg coupled to the top wall of the housing near the rear opening thereof and a long leg extended upwards therefrom and away from the housing and terminated at a handgrip for allowing a user a firm hold for plowing.

2. A hand-operated snow plow for plowing snow comprising:

an elongated housing with a front end and a rear end and wherein the housing has a central axis defined therethrough;

a pair of elongated and generally opposed blades each having an end pivotally coupled to the front end of the housing, wherein each blade is positionable in a first orientation such that an acute angle is formed between the blade and the central axis of the housing, a second orientation such that a perpendicular angle is formed between the blade and the central axis of the housing, and a third orientation such that an obtuse,angle is formed between the blade and the central axis of the housing, and wherein a front surface of each blade is coated with a non-stick layer of material for preventing snow from adhering thereto;

blade adjustment means located at the front end of the housing and actuatable through use of a locking lever extending upwards therefrom and engaging the blades for allowing independent angular positioning and securement of each of the blades with respect to the front end of the housing for thereby enabling the blades to be placed in a plurality of plowing positions; and a rigid handle extended upwards from the housing for allowing a user a firm hold for plowing.

* * * * *